US005967259A

United States Patent [19]

Williams

[11] Patent Number: 5,967,259

[45] Date of Patent: Oct. 19, 1999

[54] UTILITY TRAY FOR STEPLADDERS

[76] Inventor: Dewell F. Williams, 4309 Hendricks Dr., Woodbridge, Va. 22193

[21] Appl. No.: 09/031,590

[22] Filed: Feb. 27, 1998

[51] Int. Cl.[6] ..... E04G 1/00

[52] U.S. Cl. ..... 182/129; 248/238

[58] Field of Search ..... 182/129; 248/210, 248/238

[56] References Cited

U.S. PATENT DOCUMENTS

| | | | |
|---|---|---|---|
| 4,480,810 | 11/1984 | Hall . | |
| 4,515,242 | 5/1985 | LaChance . | |
| 4,550,803 | 11/1985 | Finster et al. . | |
| 4,653,608 | 3/1987 | Cacada . | |
| 4,730,802 | 3/1988 | Chatham et al. | 182/129 X |
| 4,862,994 | 9/1989 | Hughes, Sr. . | |
| 5,106,045 | 4/1992 | Bezotte . | |
| 5,342,008 | 8/1994 | Kay . | |
| 5,370,263 | 12/1994 | Brown | 248/210 X |
| 5,507,363 | 4/1996 | Tredup . | |
| 5,603,405 | 2/1997 | Smith | 182/129 X |
| 5,613,574 | 3/1997 | Melanson | 182/129 |
| 5,647,453 | 7/1997 | Cassells | 182/129 |

*Primary Examiner*—Daniel P. Stodola
*Assistant Examiner*—Hugh B. Thompson
*Attorney, Agent, or Firm*—Harold H. Dutton, Jr.

[57] ABSTRACT

A utility tray for use with a stepladder having a flat top step, the tray comprising a generally rectangular flat central portion, rectangular side tray compartments on opposite sides of the central portion and depending therefrom, a rectangular rear tray compartment on and depending from a third side of the central portion, and a flange depending from the fourth side of the central portion, each of the tray compartments being defined by vertical sides and a bottom orthogonal to the vertical sides; one side of each of said tray compartments forming with the flange a top step-receiving compartment, and a strap for releasably securing the utility tray to a stepladder.

5 Claims, 2 Drawing Sheets

UTILITY TRAY FOR STEPLADDERS

This invention relates to a utility tray for stepladders. More particularly, this invention relates to a utility tray sized to fit over the top of a step ladder and be retained in position on the stepladder, while being available for easy removal from the stepladder and subsequent use as a tool caddy.

BACKGROUND AND OBJECTS OF THE INVENTION

A great number of attachments have been presented in the prior art for use with ladders, to help the person using the ladder by holding a variety of tools, implements and supplies, and keeping those articles readily available for the person working on the ladder. The prior art utility trays vary depending upon where and how they are attached to the ladder, and to some extent the type of ladders with which they are used. Thus devices which are attachable to the side rails or rungs may often be used with both stepladders and with extension type ladders, whereas devices attached to the top of the ladder would ordinarily be used only with stepladders.

Thus, for example, U.S. Pat. No. 4,480,810 discloses a ladder caddy which may be attached to any rung of a ladder, on the front, i.e. the user side, of the ladder, and has a tray portion and a variety of openings, all for the purpose of holding tools, supplies and the like readily at hand.

Other U.S. Pat. Nos. such as 4,515,242, 4,550,803 and 5,106,045 disclose other types of utility attachments which are adapted to be attached to the side rail of a ladder, for holding tools and the like so they may be easily reached by the user.

Still other U.S. Pat. Nos. such as 4,653,608, 4,862,994 and 5,342,008 disclose attachments which are constructed so as to be attached to a ladder on the rear, i.e. opposite the user, for holding tools and the like while the ladder is in use.

Other devices are constructed so as to be used on the top of a stepladder, such as the ladder "apron" disclosed in U.S. Pat. No. 5,647,453.

The prior art devices have all proposed useable devices, but the commercial success of most prior art devices has been limited by the relatively narrow capability of use of the attachments. In other words, a device which is attached to the side of a ladder may work quite well for holding tools, hardware, paint, and the like on the ladder, but when the user moves off of the ladder, the device remains attached with the tools, hardware, paint and the like. One device has sought to overcome this problem, and is shown in U.S. Pat. No. 5,370,263. This device is a tool tray which is relatively easily removable from the stepladder. A retractable ladder engaging handle extends for attaching the tray to the stepladder, and retracts out of the way when being carried by the user. The tray is removed by lifting the tray over the top of the ladder.

The present invention relates to an improved utility tray for stepladders which may be easily removed from the ladder and used as a tool caddy or tote tray when so removed. In this manner, the user may work on the ground, and then as the job may require, he may carry his tools etc. with him and climb a ladder with the tray, which is then secured to the ladder while working on the ladder.

Thus, a primary object of the present invention is to provide a utility tray for carrying tools, hardware, and the like which may be readily attached to stepladders.

Another object of the invention is to provide a utility tray which has no moving parts.

Still a further object of the invention is to provide a utility tray which may be attached to a stepladder without any modification of the ladder.

Yet a further object of the invention is to provide an improved utility tray which may be used to carry tools, hardware and the like on a jobsite and easily attached to a stepladder when needed.

These and other objects and advantages of the present invention will become apparent from a detailed consideration of the present specification and drawings, together with the accompanying claims.

DESCRIPTION OF THE INVENTION

The present invention comprises a one-piece, unitary construction utility tray which is so configured as to have peripherally arranged compartments extending below the main or top central portion, the different compartments of the tray forming sidewalls for engaging the sides of the top step of the ladder and being thereby positioned on that step. The central portion has a flat under surface with a depending flange portion along the front, and the surrounding compartment portions are deeper than the flange and form the sidewalls of a downwardly opening receptacle for receiving the top step of a stepladder for securing the tray in position on the ladder. The peripheral compartments of the tray have a depth suitable for storing articles such as hardware, tools or the like small articles which then are easily available and visibly positioned for ready access.

The outer compartment tray portions of the utility tray are deeper than the thickness of the top step of most ladders and are of substantially the same size and shape, and thus provide a good engagement with that top step for positioning the tray; The side walls of these outer compartment tray portions form a variety of pockets and receptacles for holding different articles, but also form the sidewalls of the central top-step engaging or receiving portion. This enables the shape of the tray to be optimized for ease of molding as a one-piece utility tray and for mold withdrawal, while still providing an appropriate variety of different compartments and tool holding portions.

The utility tray may be secured to the stepladder by a quick-release type of attachment, and a fabric strap with a hook-and-loop fastener serves quite well for this purpose. The fabric strap wraps around the top step of the ladder and is secured to the tray at both ends by the hook-and-loop fastener. To release the tray for movement, the strap is quickly detached. A handle is preferably molded to the central portion to facilitate carrying the tray from place to place.

BRIEF DESCRIPTION OF THE DRAWINGS

The accompanying drawings show by way of non-limiting example, one illustrative embodiment of the invention in which.

DETAILED DESCRIPTION OF PREFERRED EMBODIMENTS

Figure 1:
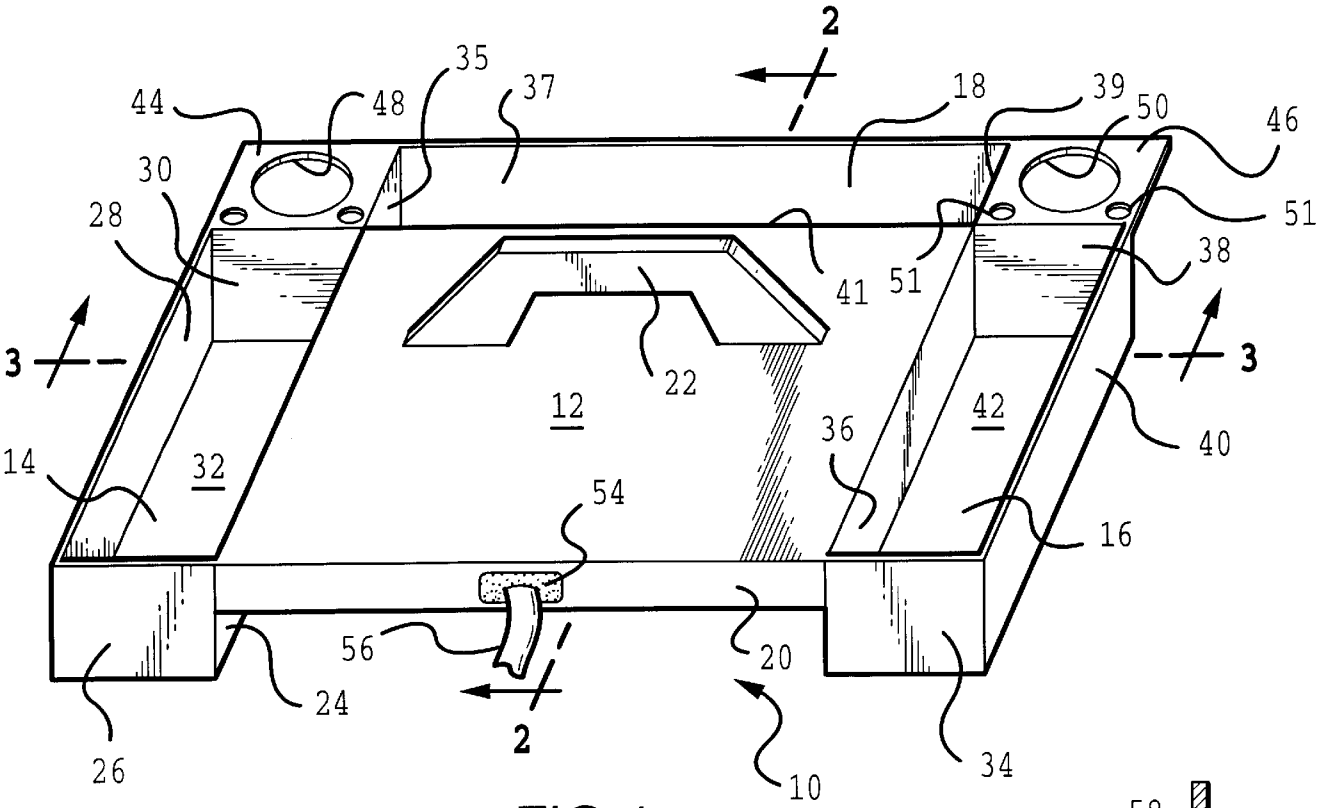
FIG. 1 is a perspective view of a utility tray according to the present invention.
Figure 2:
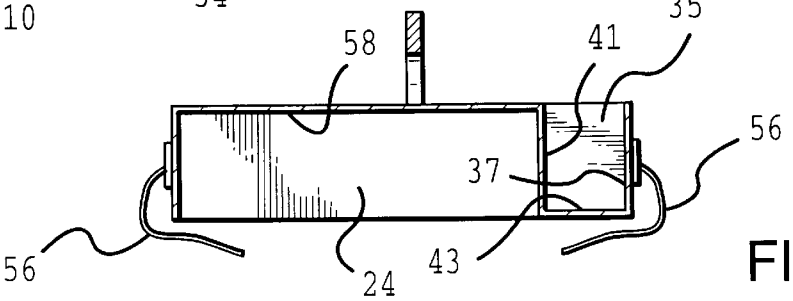
FIG. 2 is a sectional view along lines 2—2 of FIG. 1 and viewed in the direction of the arrows.
Figure 3:
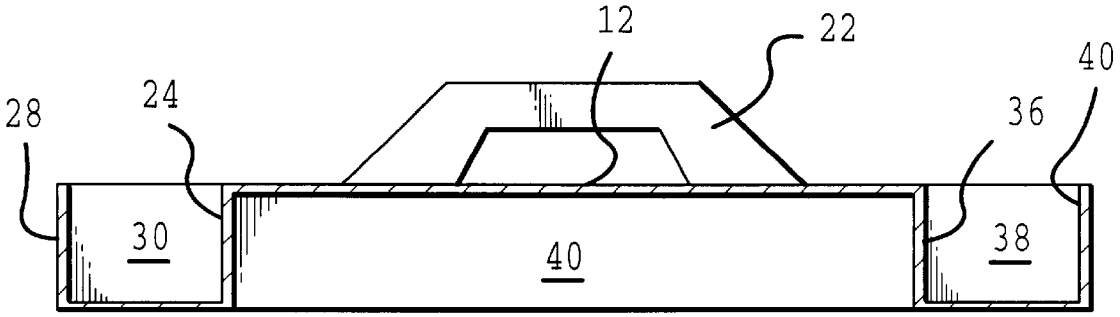
FIG. 3 is a sectional view along lines 3—3 of FIG. 1 and viewed in the direction of the arrows.

Referring now to FIGS. 1–3 of the drawings, the utility tray according to the present invention is generally designated 10 in FIG. 1 and is seen to comprise a top, central portion 12 which is surrounded on three sides by downwardly depending trays 14, 16 and 18 on the sides and rear respectively. On the fourth or front side of the portion 12 is a downwardly depending flange 20. A carrying handle 22 is integrally molded with the tray and extends upwardly from the central portion 12. Preferably the handle is positioned slightly toward the rear of the center of the portion 12 in order to more equally distribute the weight for balance when carrying the tray.

The side tray 14 is seen to include sidewalls 24, 26, 28 and 30, and a bottom 32 which collectively form and define the tray 14. Similarly, the side tray 16 includes sidewalls 34, 36, 38 and 40, and a bottom 42 which collectively form the tray 16. The rear tray 18 is formed by sidewalls 35, 37, 39 and 41, and a bottom 43. Preferably the top surface extends outwardly in the region of the corners of the tray with filler panels 44, 46 positioned between adjacent compartment trays. These filler panels may have openings 48, 50 and 51 formed therein for receiving a variety of tools or implements, even including receptacles containing liquids.

On the front of the central portion 12 is a downwardly extending flange 20, which may, but need not, extend the full depth of the compartments 14, 16 and 18. This flange preferably has an adhesively attached piece of one side of a hook-and-loop fastener material 54, and a similar piece is secured to the outside of the rear wall 37. A flexible strap schematically shown at 56 is of such a length that it may extend around the top step of a ladder and be secured to the rear piece of fastener material, thereby securely attaching the utility tray to the stepladder.

As is apparent, one wall of each of the compartment trays 14, 16, and 18 form, along with flange 52, a compartment 58 for receiving the top step of a stepladder. This compartment is preferably of essentially the same size and shape as the top step of the ladder with which the utility tray will be used.

Figure 4:
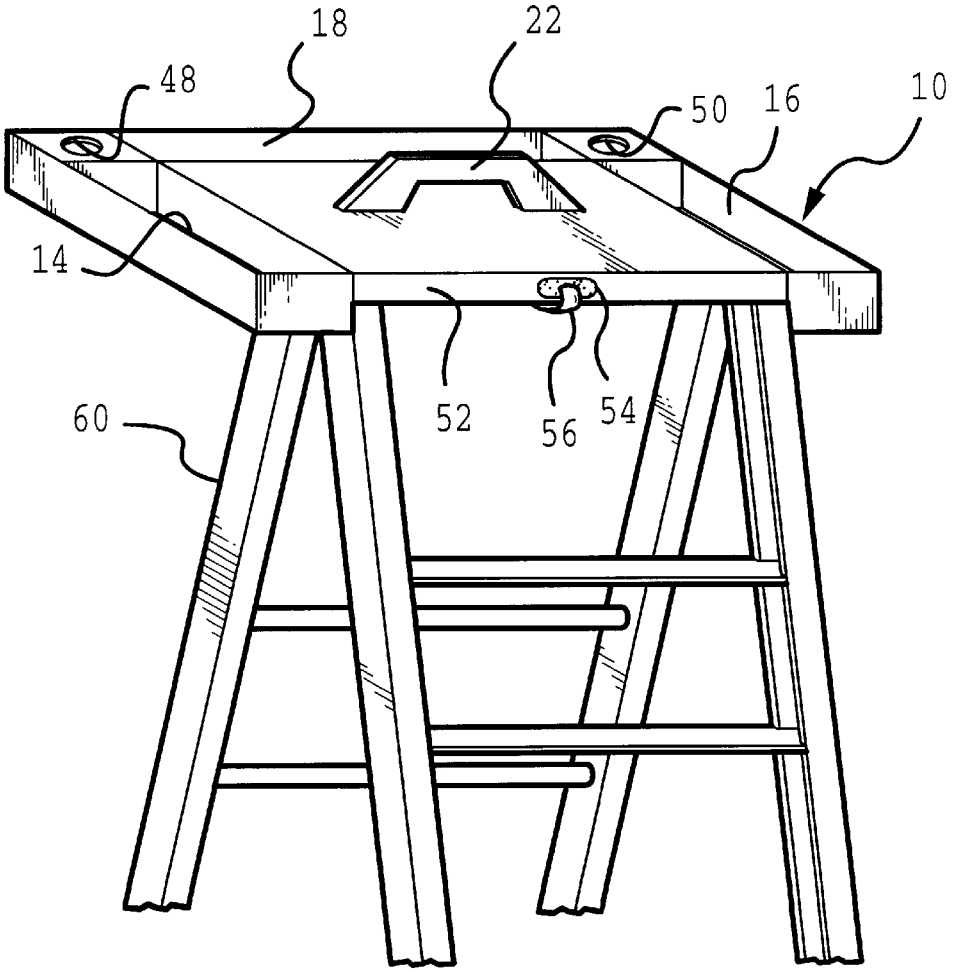
FIG. 4 is a perspective view showing the utility tray positioned on the top step of a stepladder.

As shown in FIG. 4, the utility tray 10 is simply placed on the top step (not shown) of a stepladder 60, and the strap 56 is passed beneath the top step and secured to the rear of the compartment 18. This provides a quickly releasable but secure attachment of the tray to the ladder, in order that the user may quickly climb off of the ladder and carry his tools and supplies with him, and may just as easily return and secure the tray in place.

While this invention has been described as having certain preferred features and embodiments, it will be apparent that it is capable of still further variation and modification without departing from the spirit of the invention, and this application is intended to cover any and all variations, modifications and adaptations of the invention as may fall within the spirit of the invention and the scope of the appended claims.

I claim:

1. A step ladder having a substantially flat top step and an easily removable utility tray on said top step, said tray comprising a generally rectangular flat central portion, rectangular side tray compartments on two opposite sides of said central portion and depending therefrom, a rectangular rear try compartment on and depending from a thick side of said central portion, and a flange depending from the fourth side of said central portion, each of said tray compartments being defined by vertical sides and a bottom orthogonal to the vertical sides; one side of each of said tray compartments forming with said flange a top step receiving compartment the interior sides of which engage the sides of the top step of said ladder and extend below said top step for preventing lateral displacement of said tray relative to said top step, the top edges of said side tray compartments being substantially even with the upper surface of said central portion, one face of said tray being formed by sides of greater depth than the center thereof so as to be stepped, and means for releasably securing said utility try to said stepladder.

2. A utility tray as in claim 1 and wherein said releasable securing means comprises a flexible strap attachable to said tray and adapted to encircle the top step of a stepladder.

3. A utility tray as in claim 2 and including filler panels between adjacent ones of said compartment trays, and openings formed in said filler panels for receiving tools.

4. A utility tray as in claim 3 and wherein said releasable securing means comprises a hook-and-loop fastener.

5. A step ladder as in claim 1, and wherein said releasable securing means comprises flexible means encircling said top step.

* * * * *